US005448955A

United States Patent [19]

Dugge et al.

[11] Patent Number: 5,448,955

[45] Date of Patent: Sep. 12, 1995

[54] GRAVITY OUTLET LATCHING MECHANISM

[75] Inventors: Richard H. Dugge, Des Peres, Mo.; Gregory E. Bertram, Valmeyer, Ill.

[73] Assignee: ACF Industries, Earth City, Mo.

[21] Appl. No.: 304,759

[22] Filed: Sep. 12, 1994

[51] Int. Cl.[6] ..... B61D 3/00; B61D 9/00

[52] U.S. Cl. ..... 105/305; 105/282.3; 105/310.1; 105/311.2

[58] Field of Search ..... 105/282.1, 282.3, 286, 105/294, 305, 310, 310.1, 311.2, 308.1, 308.2

[56] References Cited

U.S. PATENT DOCUMENTS 3,110,270 11/1963 Ingram ..... 105/282.3 X
3,387,570 6/1968 Pulcrano et al. ..... 105/305 X
5,353,713 10/1994 Dohr et al. ..... 105/310

*Primary Examiner*—Robert J. Oberleitner
*Assistant Examiner*—Kevin D. Rutherford
*Attorney, Agent, or Firm*—Polster, Lieder, Woodruff & Lucchesi

[57] ABSTRACT

A gravity outlet (10) for discharging lading from a railway car (C). An outlet assembly attached to a discharge opening in the railcar includes an upper end attached to the opening and sidewalls (12*a*, 12*b*) and endwalls (14*a*, 14*b*) whose bottom portion defines an outlet (D) through which lading flows, by gravity, when discharged from the railcar. An outlet gate (34) positioned beneath the outlet assembly moves relative to the discharge outlet between respective open and closed positions. A latch mechanism (36) includes a latch (50*a*, 50*b*) pivotally attached to the gate to latch the gate in its closed position and prevent inadvertent opening of the gate and spillage of lading. A gate operating mechanism (38) includes a rack (40) attached to the gate and a pinion (42) engaging the rack for moving the rack and the gate. A capstan (46) is connected to an operating shaft (44), as is a coupling member (64). Rotation of the capstan by yard personnel effects movement of gate between its open and closed positions. A blocking bar (62) is engaged by the coupling member to lock the gate in its closed position. A lost motion connection between the pinion and the coupling member enables the gate to be unlocked prior to movement of the rack by the pinion, and locked in its closed position subsequent to movement thereto by the rack and pinion. The arrangement produces a desired sequence of gate operations (unlocking, opening, closing, relocking) which occur automatically.

20 Claims, 9 Drawing Sheets

GRAVITY OUTLET LATCHING MECHANISM

BACKGROUND OF THE INVENTION

This invention relates to gravity outlets used to discharge lading from covered hopper railway cars, and, more particularly, to a gravity outlet which meets current American Association of Railways (AAR) regulations for such outlets.

In co-pending United States patent application Ser. No. 08/186,377 filed Jan. 25, 1994, which is assigned to the same assignee as the present application, there is described a gravity outlet for use on railroad hopper cars of the type used in grain service. As noted therein, the AAR has recently promulgated new regulations concerning gravity outlet design and operation. This new regulation is AAR standard S-233 and addresses such issues as hopper outlet design, installation, and maintainence to prevent water, waste, and debris contamination of the lading during transit. Also addressed are torque requirements for a latching mechanism used to open and close the outlet, and automation and accessibility of the latching mechanism to facilitate offloading of grain from a railcar.

In our co-pending application, we describe a latching mechanism for opening and closing a gravity outlet. While the mechanism described therein functions to achieve the desired operational results, and meets the AAR standard, other latching mechanism constructions could also be employed to achieve the same result.

SUMMARY OF THE INVENTION

Among the several objects of the present invention may be noted the provision of a gravity outlet for use on covered hopper railway cars used in grain service; the provision of such an outlet having a gate movable relative to the outlet to open and close the outlet, a mechanism for moving the gate, and a latch mechanism for locking the gate in its closed position and for unlocking the gate so the outlet can be opened; the provision of such an outlet in which operation of the gate operating mechanism and latching mechanism are integrated so movement of the gate operating mechanism automatically unlatches the gate so it can be opened, and automatically latches the gate in a locked position when it closed; the provision of such a mechanism to use lost motion so unlocking and opening of the gate, and closing and relocking of the gate are done in a desired sequence; the provision of such a mechanism having a lost motion feature by which there is 20°–35° of free travel between the start of an unlatching sequence until the gate begins opening, and a similar amount of travel between the gate being closed and the latching mechanism locking the gate in place; the provision of such an outlet to meet AAR standards concerning gravity outlet design and operation for use in grain service; and, the provision of such an outlet which can be used both as original equipment on a railcar, or as a retrofit.

In accordance with the invention, generally stated, a gravity outlet is for discharging lading from a railway car. An outlet assembly attached to a discharge opening in the railcar includes an upper end attached to the opening, and sidewalls and endwalls whose bottom portion defines an outlet through which lading flows, by gravity, when discharged from the railcar. An outlet gate positioned beneath the outlet assembly moves relative to the discharge outlet between respective open and closed positions. A latch mechanism includes a latch attached to the gate to latch the gate in its closed position and prevent inadvertent opening of the gate and spillage of lading. A gate operating mechanism includes a rack attached to the gate and a pinion engaging the rack for moving the rack and the gate. A capstan is attached to an operating shaft for rotating the shaft in an appropriate direction to move the gate between its open and closed positions. A coupling member is connected to the capstan and engages the pinion to rotate the pinion and move the rack. A blocking bar is engaged by the coupling member and is movable thereby to unlock the gate while the gate is still in its closed position. There is a lost motion connection between the pinion and the coupling member for effecting this unlocking of the gate prior to movement of the rack by the pinion to open the gate, and for locking the gate subsequent to its movement back to its closed position. A desired sequence of gate movement is automatically achieved using this arrangement. Other objects and features will be in part apparent and in part pointed out hereinafter.

BRIEF DESCRIPTION OF THE DRAWINGS

Corresponding reference characters indicate corresponding parts throughout the drawings.

DESCRIPTION OF A PREFERRED EMBODIMENT

Figure 1:
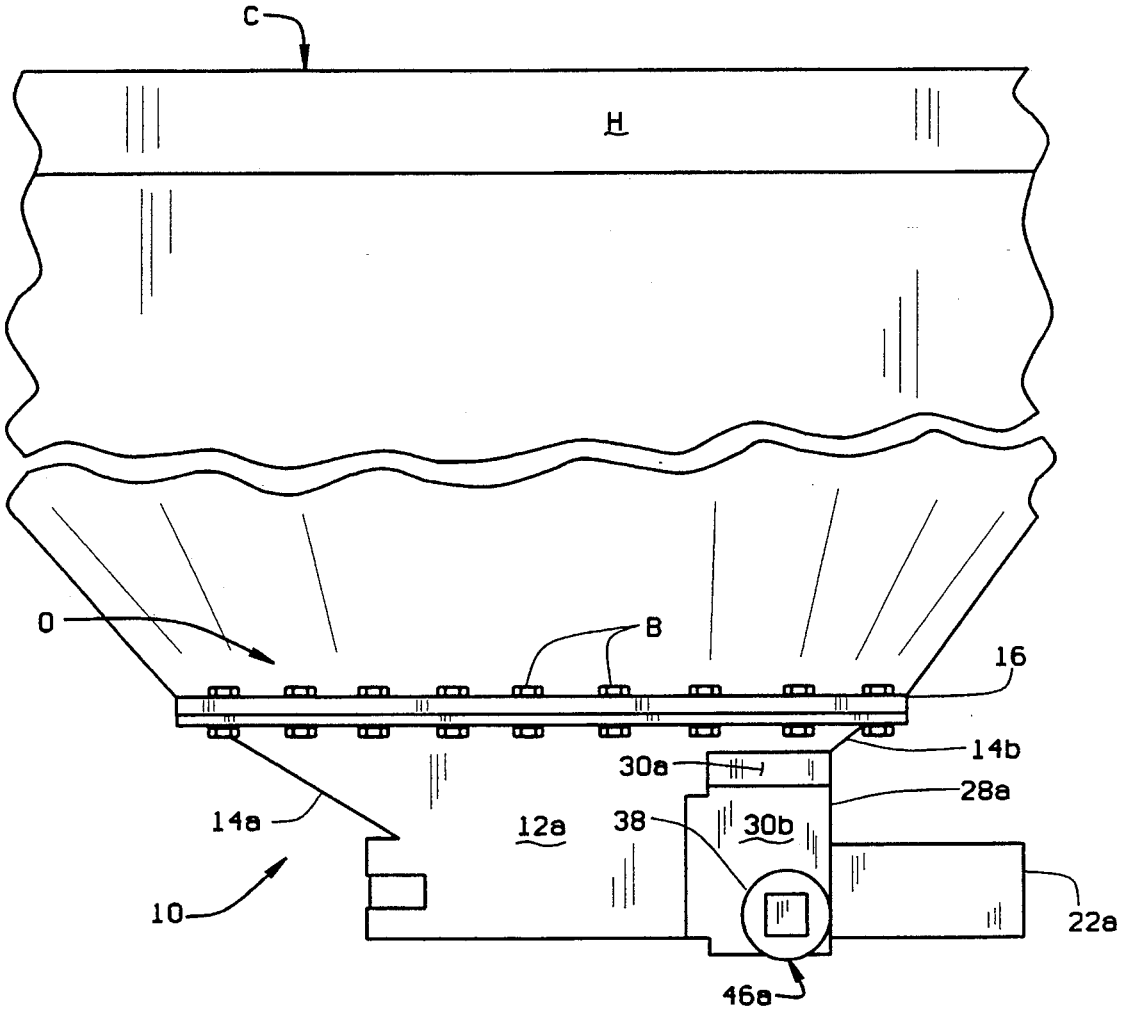
FIG. 1 is a partial elevational view of a railcar with a gravity outlet of the present invention installed.

Referring to the drawings, a covered hopper railway car C is for transporting lading such as grain. A gravity outlet 10 is installed at a lower outlet O of a railcar hopper H. When open, the outlet allows grain to discharge through the outlet for offloading from the railcar. Construction of outlet 10 is fully described in co-pending application Ser. No. 08/186,377, which is incorporated herein by reference.

Figure 2A:
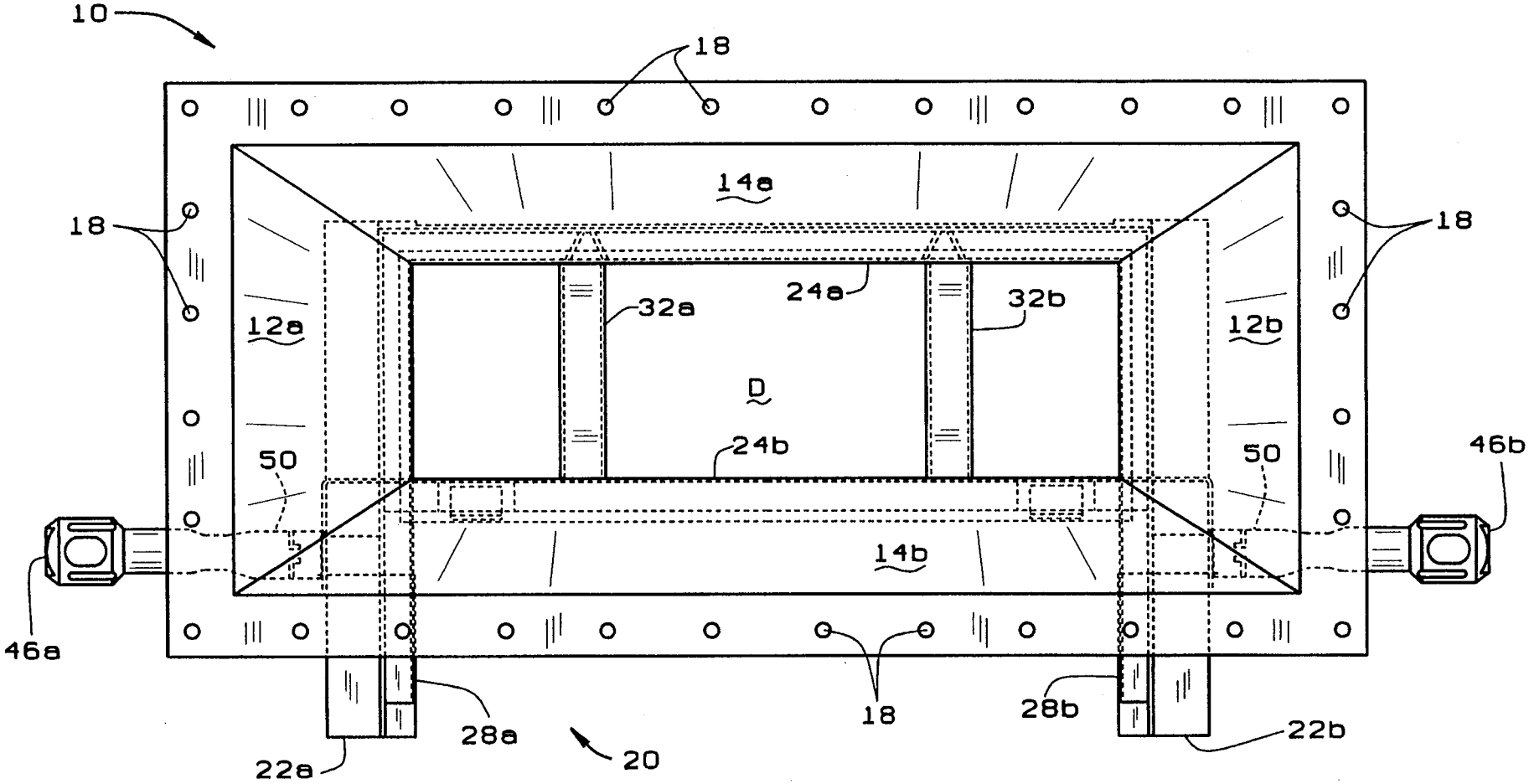
FIG. 2A is a top plan view of the outlet and FIG. 2B is a top plan view of a gate support structure for the outlet.

Gravity outlet 10 is formed of respective opposed sidewalls 12*a*, 12*b*, and opposed endwalls 14*a*, 14*b*; these being generally trapezoidal when viewed in plan as shown in FIG. 2A. The sidewalls extend lengthwise of the railcar, the endwalls transversely thereof. Each sidewall and endwall has an outwardly turned, horizontally extending flange formed at its upper end. The flanges mate with respective portions of a flange 16 for mounting outlet 10 to opening O. The flanges have spaced bolt holes 18 for this attachment using bolts B. Each sidewall and endwall slopes downwardly and inwardly from the upper end of the outlet. The bottom of the sidewalls and endwalls define a generally rectangular discharge outlet D through which the grain flows, by gravity, when discharged from the railcar.

Figure 2B:
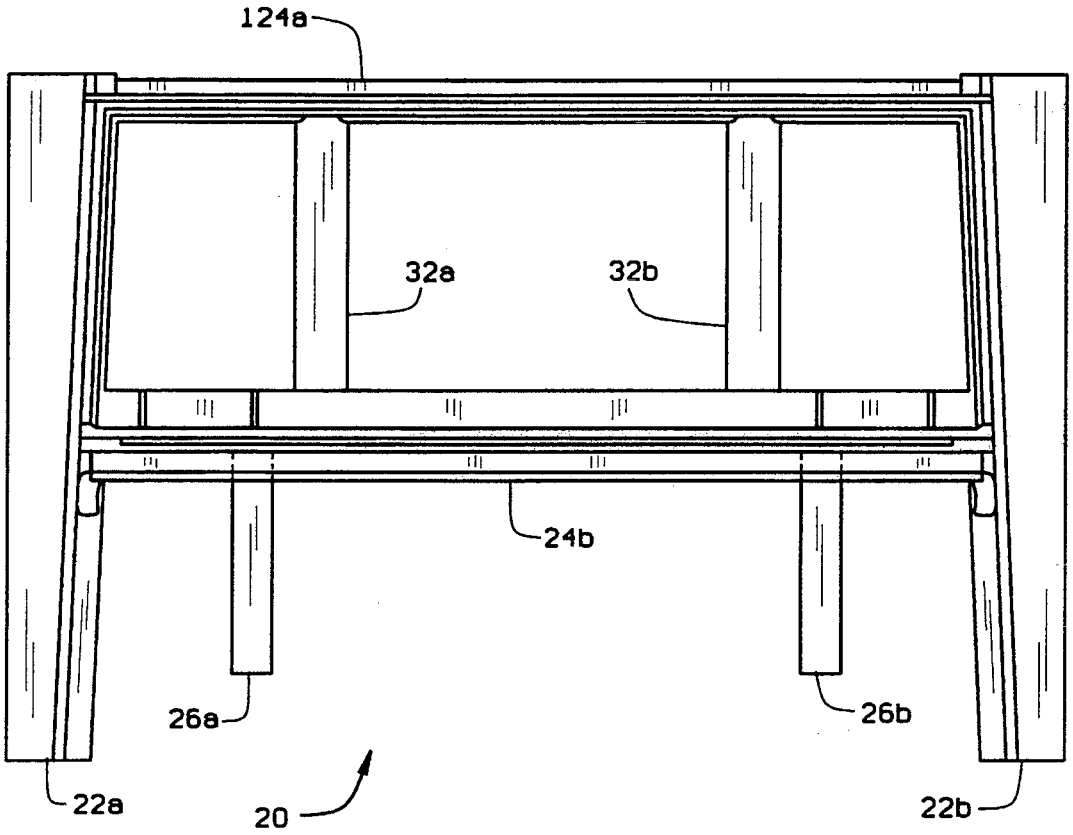

In FIG. 2B, a support structure 20 for the outlet includes longitudinally extending boot flanges 22*a*, 22*b* respectively extending beneath sidewalls 12*a*, 12*b*. Similar flanges 24*a*, 24*b* extend beneath the endwalls. Inverted L-shaped gate support members 26*a*, 26*b* extend rearwardly from endwall 14*b* on either side of the longitudinal centerline of the outlet. Respective side plates 28*a*, 28*b* (see FIG. 1) also extend longitudinally of the sidewalls. Each plate has a vertically depending lower section 30*b* and an upper section 30*a* which is angled to abut against the outer face of the sidewalls. Support structure 20 further includes spaced, inverted U-shaped supports 32*a*, 32*b*. These extend longitudinally of the outlet between support elements 24*a*, 24*b*. Because of their rounded upper ends, grain falling on the top of these supports readily falls off through the outlet.

Figure 3:
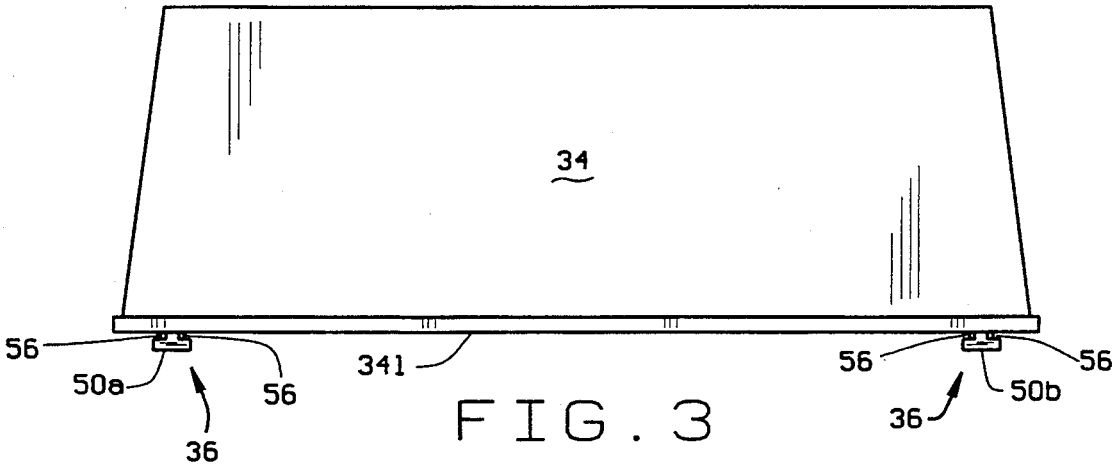
FIG. 3 is a plan view of the outlet gate with a latch mechanism installed thereon.

An outlet gate 34 (see FIG. 3) positioned beneath the outlet assembly is trapezoidal, when viewed in plan, and has an upwardly turned lip 34L at its rearward end. The lip height exceeds that of the opening formed between the lower end of the outlet's sidewalls and endwalls, and its support structure members (see FIGS. 8A and 8B). Gate 34 is movable between a closed position to an open position for lading discharge. A latch mechanism 36 latches or locks gate 34 in its closed position, and a gate operating mechanism 38 is used to move the gate 22 between its respective open and closed positions. Importantly, gate operating mechanism 38 automatically unlatches latch assembly 36 prior to the gate operating mechanism moving the gate from its closed position. And, the gate is automatically relatched when it is subsequently moved back to its closed position.

Figure 4:
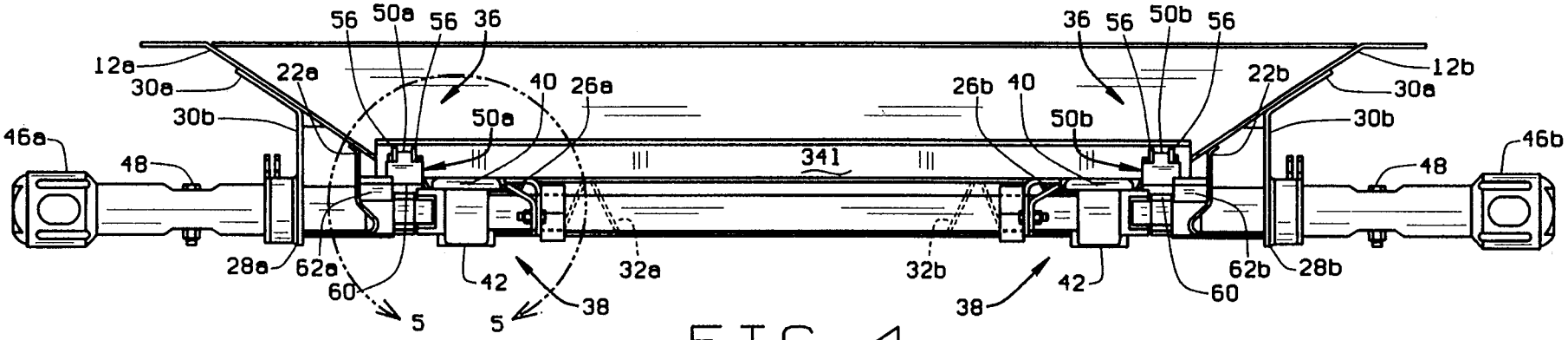
FIG. 4 is an end elevational view of the outlet.
Figure 5:
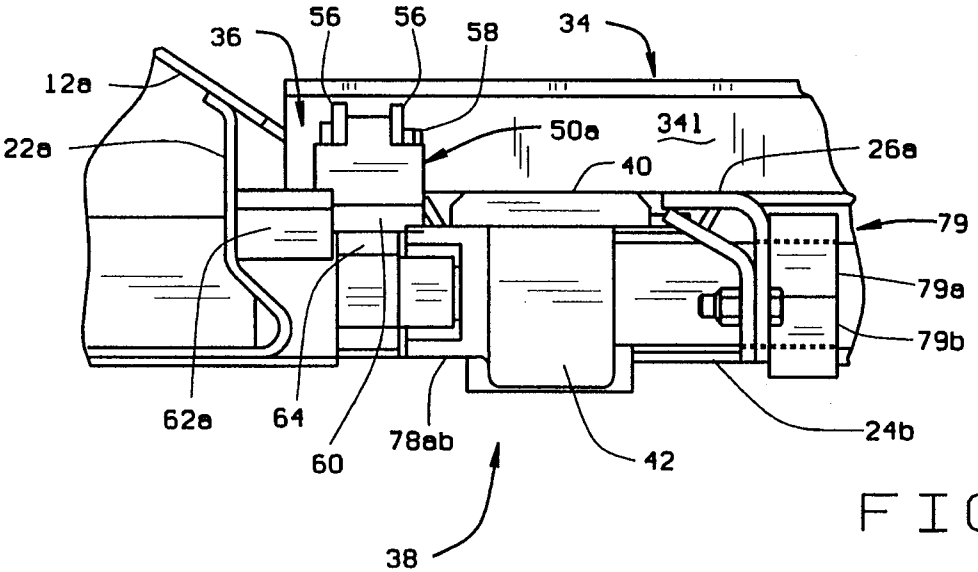
FIG. 5 is a partial end elevational view taken along line 5—5 in FIG. 4.
Figure 6A:
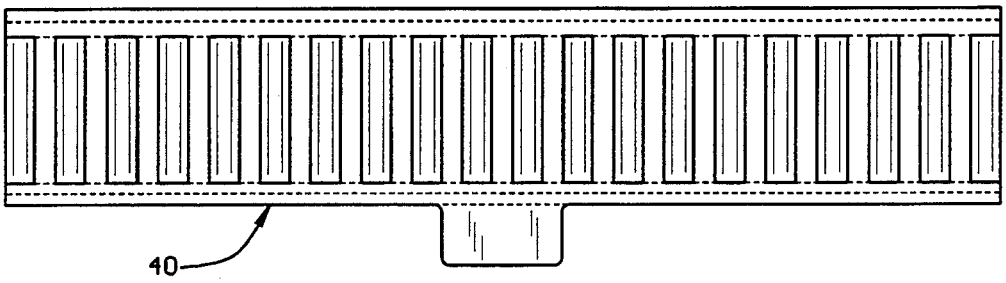
FIGS. 6A and 6B are respective plan and elevational views of a rack installed on the bottom of the gate for moving the gate.
Figure 6B:
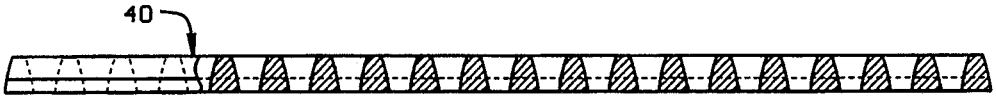

Gate operating mechanism 38 includes a rack 40 (see FIGS. 6A and 6B) and a pinion gear assembly or pinion 42 for moving the rack in the appropriate direction. An operating shaft 44 extends transversely of the gate. As shown in FIG. 4, respective capstans 46*a*, 46*b* are attached to the respective ends of the operating shaft as indicated at 48. A yardman or other personnel using an appropriate tool can turn the capstan to effect unlatching and opening, and closing and relatching of gate 34 via the latching and gate operating mechanisms. This can be done from either side of the railcar. Further, there is a rack 40/pinion 42 arrangement located on both sides of the gate. In each instance, the rack is attached to the underside of the gate and the pinion has gear teeth which mesh with the rack, all as is well-known in the art.

Figure 7:
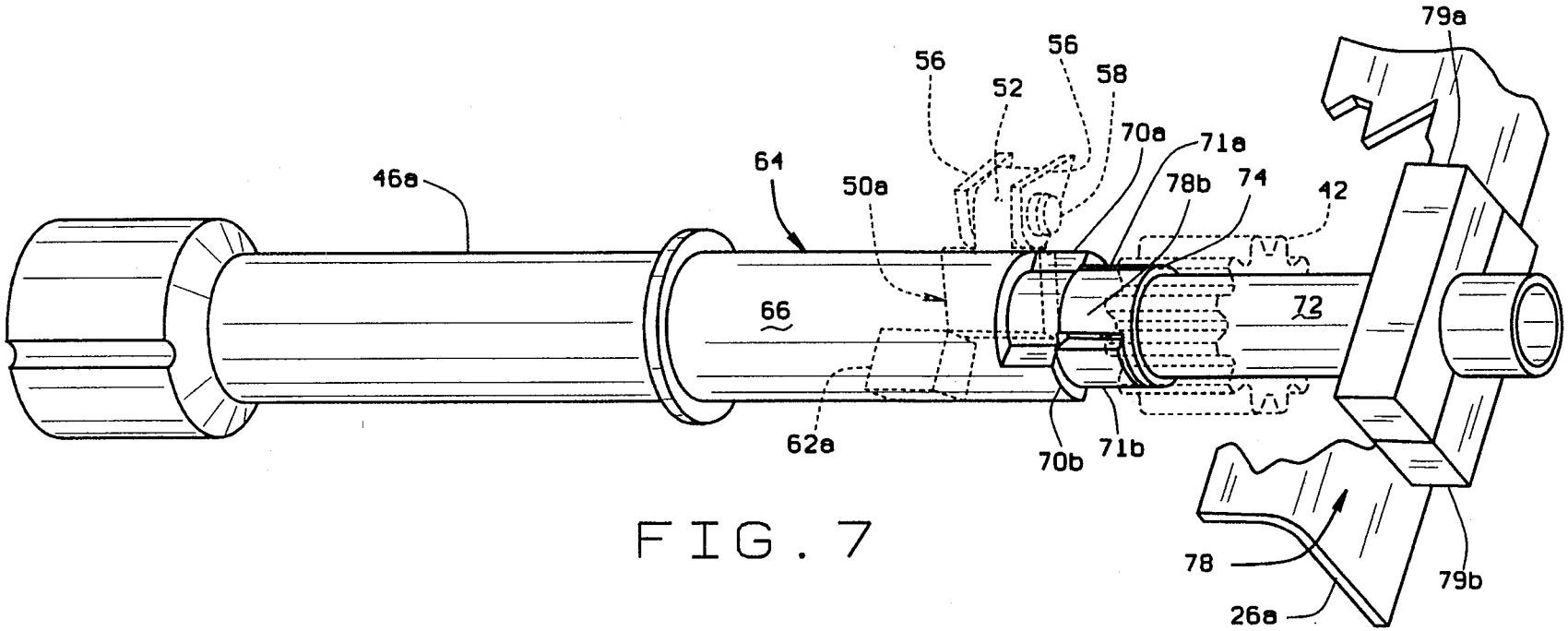
FIG. 7 is a perspective view of the apparatus of the present invention for Opening and closing the gate.
Figure 13:
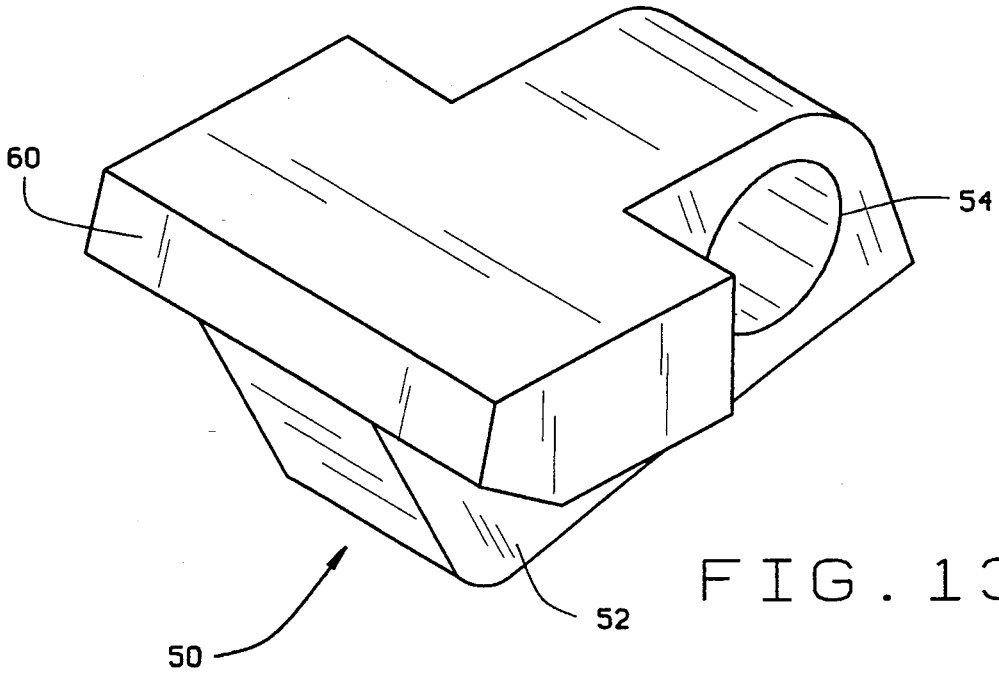

Latch mechanism 36 includes respective latch members 50*a*, 50*b* which are mounted on backside or outer face of the upwardly turned lip portion 34*l* of gate 34 (see FIGS. 3, 4, 8*a*, 8*b*). Each latch member has a main body 52 (see FIG. 13) in one end of which is a transversely extending bore 54 for pivotally mounting the latch member between ears 56 which extend outwardly from the outer face of gate lip 34*l*. A pin, or nut and bolt assembly 58, is used to mount the latch member in place. At the outer, upper end of the latch member body is a transversely extending head 60. Latch mechanism 36 further includes respective blocking bars 62*a*, 62*b* which are mounted on an inner face of the respective support members 22*a*, 22*b*. The blocking bars are each generally rectangular in shape and are positioned so when gate 34 is closed head 60 of the latch member 50 abuts against the bars to keep gate 34 locked in place. As shown in FIG. 9, a coupling member 64 which is integrally formed with a capstan. The coupling member includes a sleeve 66 having an inner diameter sized for the coupling member to fit over operating shaft 44. Further as shown in FIGS. 7 and 9, the coupling member includes respective collar segments 70*a*, 70*b*. These segments are opposed segments which extend longitudinally of the sleeve and subtend an arc which is, for example, 75°.

Figure 11:
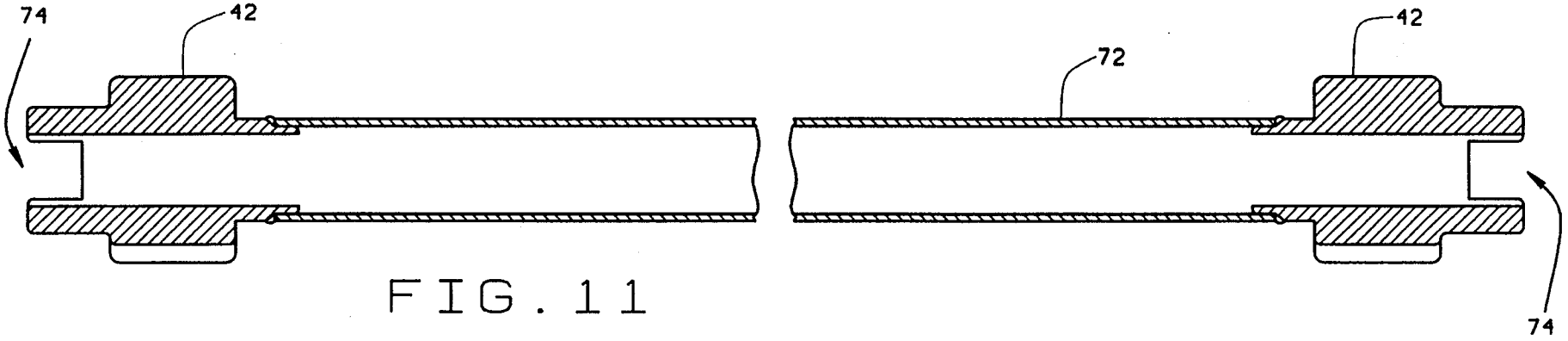
FIG. 11 is a sectional view of the pinion gear/sleeve assembly; elevational view of a pinion forming a portion of the gate operating mechanism.
Figure 10:
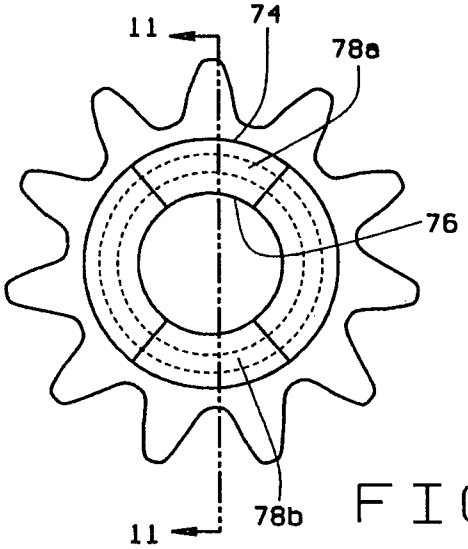
FIG. 10 is an end elevational view of a pinion gear/-sleeve assembly of the apparatus.
Figure 12:
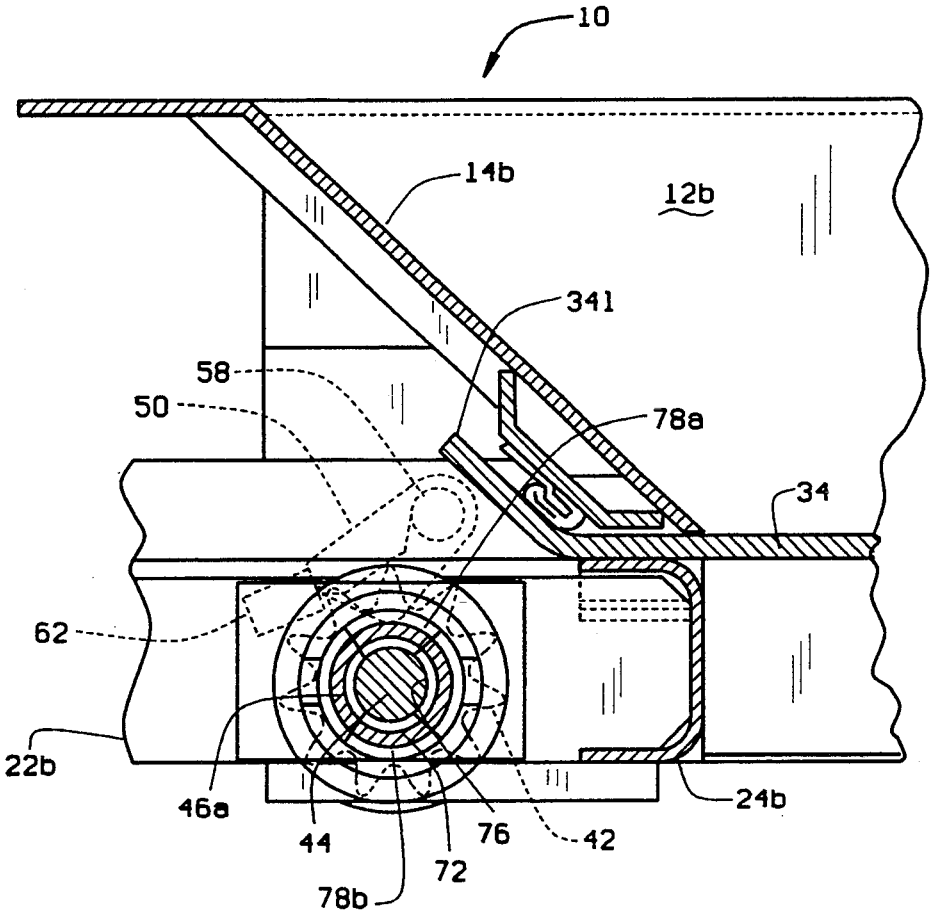
FIG. 12 is an elevational view, partly in section, of the latching and gate operating mechanisms of the outlet; and, FIG. 13 is a perspective view of a latch member of the latching mechanism.

Referring now to FIG. 11, the pinions gear assemblies 42 are shown as being attached to each end of a sleeve 72 whose inner diameter is greater than that of operating shaft 44. Attachment is by welding, for example. With this configuration, rotation of the operating shaft by turning of a capstan does not, of itself, effect rotation of the pinion to move rack 40 and gate 34. A collar section 74 is formed at each end of each pinion sleeve 72. As with coupling member 64, collar 74 has opposed collar segments 78*a*, 78*b*. Each collar segment subtends an arc which is also, for example, 75°. As shown in FIG. 7, the collar segments of the coupling member and those of the pinion assembly are arranged so as to be 90° from one another. As a result, the respective collar segments interfit with each other. As shown in FIG. 7, collar segments 70*a*, 70*b* have respective extensions 71*a*, 71*b* which extend into the space between respective collar segments 78*a*, 78*b*. In FIG. 7, a support means 79 is mounted on an inner wall of each of the support members 26*a*, 26*b*. These support members support pinion sleeve 72 at points intermediate the length of the sleeve. Means 79 includes upper and lower support pillow blocks 79*a*, 79*b* each having a semi-circular opening formed therein. The blocks matingly fit. Sleeve 72 is cradled in the respective blocks.

Figure 8A:
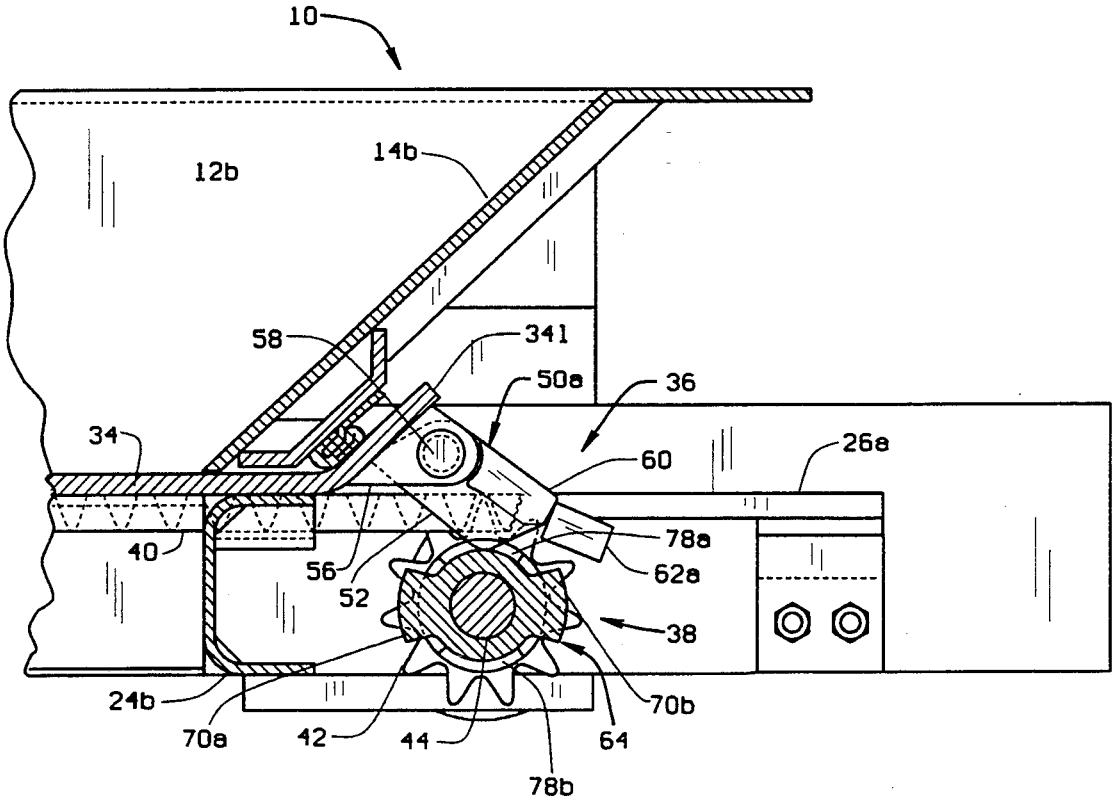
FIG. 8A is a partial side elevational view of the outlet with the gate in its locked position.
Figure 8B:
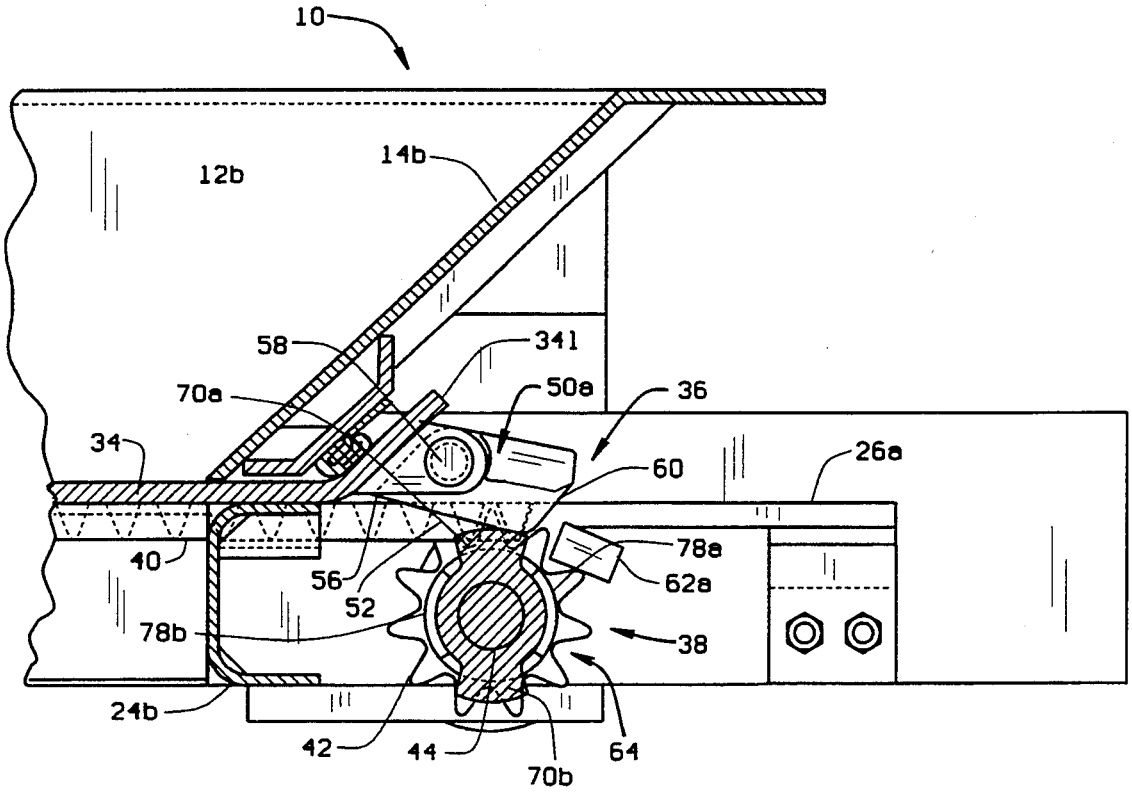
FIG. 8B is a similar view with the gate in its unlocked position.
Figure 9:
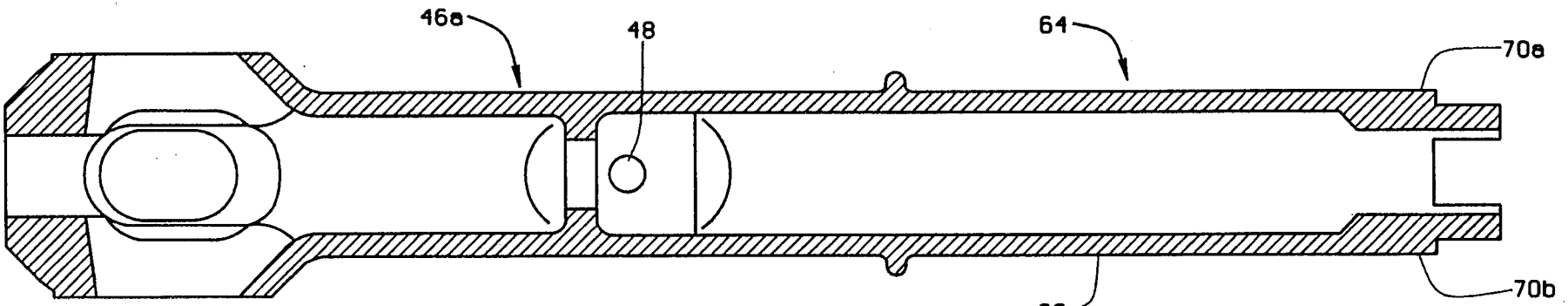
FIG. 9 is a sectional view of a capstan and coupling member of the apparatus.

Operation of the latching and gate opening and closing mechanisms is such that when gate 34 is closed, coupling members 64 are rotated to a position where the respective latch members 50*a*, 50*b* are drawn over the blocking bars to their FIG. 8A position in which head 60 of each latch member butts against its associated blocking bar. The gate is locked in its closed position at this time. When yard personnel wish to open the gate, they insert a tool in one of the capstans 46*a*, 46*b* and turn the capstan in the appropriate direction. Turning the capstan also causes rotation of the coupling member 64 connected to the capstan. And, because the capstans are connected to each other through operating shaft 44, turning of the one capstan and its associated coupling member also produces turning of the other capstan and its associated coupling member.

During the initial rotational movement of the coupling members, the collar segments of the members turn through the gap between the collar segments of the pinion with which they interfit. Since the respective collar segments of both the coupling member and pinion subtend a 75° arc, the coupling member can freely turn through up to a 30° arc before the collar segments of the coupling member engage the collar segments of the pinion. As a practical matter, the respective collar segments of the coupling member and pinion can be sized so the coupling member can turn through a 20°-35° arc before the collar segments of the coupling member engage the collar segments of the pinion.

Initial movement of the coupling members serves to rotate segment 70*a* against the underside of the latch member 50*a*, 50*b*. Further rotation of the capstan causes the coupling member segment to lift the latch member until it clears the blocking bar. Once the collar segments 70*a*, 70*b* of the coupling members engage the collar segments 78*a*, 78*b* of the pinion, the two elements rotate in unison with rotation of the pinion gear moving the rack and the gate. Continued turning of the capstan moves gate 34 to its fully open position.

When the grain is fully discharged from the hopper, the capstan is turned in the opposite direction to close the gate. The collar segments of the coupling member and pinion remain engaged during closing. Whereas during opening, the collar segments of the coupling member bore against those of the pinion to rotate the pinion; now, the reverse occurs. When the pinion reaches its rotational position at which the gate is closed, its turning stops and the collar segments of the coupling member and pinion disengage. Continued rotation of the capstan continues rotation of the coupling members. Now, gate 34 movement draws the latch members back across the blocking bars. When clear of the blocking bars, the latch members fall into their locked position, locking gate 34 closed.

By providing the lost motion between the coupling members and their associated pinion, both during opening and closing of the gate, a desired sequence of operations; i.e., unlocking the gate, opening the gate, closing the gate, relocking the gate, is achieved. Further, this sequence occurs automatically without the yard personnel having to do anything other than turning one of the capstans in the appropriate direction.

The gate has an associated seal which is effected between the gate and the respective sides of the outlet to prevent dirt, dust, moisture, etc., from contaminating the lading. This seal is described in co-pending United States patent application Ser. No. 08/186,373 filed Jan. 25, 1994, and assigned to the same assignee as the present application. The teachings of this co-pending application are incorporated herein by reference. Accordingly, a seal assembly for the gravity outlet will not be described.

What has been described is a gravity outlet used on covered hopper railway cars which haul grain. The outlet has a gate movable relative to a discharge opening of the outlet to open and close the outlet. An operating mechanism moves the gate, and a latch mechanism locks the gate in its closed position. Operation of the operating mechanism and latching mechanism is integrated so that movement of the gate operating mechanism automatically unlatches the gate when the gate is to be opened, and automatically latches the gate in a locked position after the gate is closed. A lost motion arrangement is incorporated into the structure so unlocking and opening of the gate, and closing and relocking of the gate, are accomplished in a desired sequence utilizing but a single, simple mechanism. The outlet is constructed to rapidly discharge lading and to have no areas where lading might collect and contaminate subsequent ladings. A sealing arrangement prevents external contamination of the lading. Overall design of the outlet meets AAR standards concerning gravity outlet designs. The outlet is usable both as original equipment on a railcar, and as a retrofit outlet.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. A gravity outlet for discharging lading from a railway car comprising: means defining an outlet assembly attached to a discharge opening in the railcar, the assembly including an upper end attached to the discharge opening and sidewalls and endwalls sloping downwardly and inwardly from the upper end with a bottom portion of the sidewalls and endwalls defining a discharge outlet through which lading flows, by gravity, when discharged from the railcar;

an outlet gate positioned beneath the outlet assembly and movable relative to the discharge outlet between respective open and closed positions to open and close the outlet;

latch means including a latch attached to the gate for latching the outlet gate in its closed position when the gate is closed to prevent inadvertent opening of the gate and spillage of lading; and, gate operating means including a rack attached to the gate and a pinion engaging the rack for moving the rack and the gate, an operating shaft to which the pinion is coupled for rotation in an appropriate direction to move the gate between its open and closed positions, and blocking means for engaging the latch to lock the gate in its closed position, the latch being movable out of engagement with the blocking means by movement of the gate operating means in a gate opening direction, there being a lost motion connection between the pinion and the operating shaft by which an initial movement of the operating shaft, when the gate is to be opened, effects said unlocking of the gate prior to movement of the rack by the pinion, and movement of the gate by the operating shaft, when the gate is closed, re-engaging the latch means with the blocking means subsequent to the pinion moving the rack so the gate is closed the gate operating means further including a capstan installed at each end of the operating shaft by which a yardman can open and close the gate from either side of the railcar by turning the capstan in the appropriate direction with a tool, and a coupling member for engaging the pinion, the blocking means including a blocking bar, and the coupling member moving the latch into and out of engagement with the blocking bar to lock and unlock the gate.

2. The gravity outlet of claim 1 wherein the pinion has a central opening therethrough sized for the pinion to be fit over said operating shaft, the pinion including a sleeve having an inner diameter greater than that of the operating shaft, with opposed collar segments being formed at one end of the sleeve and extending longitudinally of the operating shaft after installation of the pinion thereon.

3. The gravity outlet of claim 2 wherein the coupling member comprises a hollow cylindrical sleeve sized for the coupling member to be received on said operating shaft.

4. The gravity outlet of claim 3 wherein the coupling member further includes opposed collar segments formed at one end of the hollow cylindrical sleeve of the coupling member and extending longitudinally of the operating shaft after installation of the coupling member thereon.

5. The gravity outlet of claim 4 wherein the pinion and coupling member are installed on the operating shaft such that the collar segments of the pinion interfit with the collar segments of the coupling member.

6. The gravity outlet of claim 5 wherein the coupling member is rotatable by turning of the capstan a predetermined distance prior to the collar segments of the coupling member contacting the collar segments of the pinion, the pinion remaining stationary during this initial movement of the coupling member for a collar segment of the coupling member to move the latch out of engagement with the blocking bar to a position unlocking the latch and gate.

7. The gravity outlet of claim 6 wherein the collar segments of the coupling member interlock the coupling member with the pinion, after the aforesaid initial movement, for continued turning of the capstan to effect rotation of the pinion for the pinion to move the gate in an opening direction.

8. The gravity outlet of claim 7 wherein the collar segments of the coupling member remain interlocked with the collar segments of the pinion, when the capstan is turned in the opposite direction to close the gate, for the pinion to move the gate to its closed position.

9. The gravity outlet of claim 8 wherein the coupling member is rotatable by the continued turning of the capstan, after the gate is closed, a predetermined distance by which the latch is brought back into engagement with the blocking bar to lock the gate in its closed position.

10. The gravity outlet of claim 9 wherein collar segments of the coupling member are rotatable approximately 20°–35° prior to contacting the interfitting collar segments of the pinion, and after being rotated out of contact therewith.

11. The gravity outlet of claim 1 wherein the latch is pivotally attached to the gate and has an outer face contacted by the blocking bar when the latch is brought into engagement with the blocking bar.

12. The gravity outlet of claim 11 further including support means for supporting one end of the pinion sleeve.

13. The gravity outlet of claim 12 wherein the support means includes a pillow block assembly mounted on a support member for the outlet, the assembly including first and second mating block sections having a central opening in which the one end of the pinion sleeve is received for supporting the pinion during its rotation by the coupling member.

14. Apparatus for discharging grain from a railway car in which an outlet assembly attached to a discharge opening in the railcar includes an upper end attached to the discharge opening and sidewalls and endwalls sloping downwardly and inwardly from the upper end with a bottom portion of the sidewalls and endwalls defining a discharge outlet through which grain flows by gravity from the railcar, the apparatus comprising:

an outlet gate positioned beneath the outlet assembly and movable relative to the discharge outlet between respective open and closed positions;

latch means including a latch for pivotally mounted on the gate for latching the outlet gate in its closed position to prevent inadvertent opening of the gate and spillage of lading, gate operating means including a rack attached to one surface of the gate, a pinion engaged with the rack, and an operating shaft for rotating the shaft in the appropriate direction to move the gate between its open and closed positions, a capstan being connected to each end of the operating shaft for rotating the shaft from either side of the railcar;

a blocking bar for locking the gate in its closed position; and, a coupling member carried on the operating shaft and engaging the pinion, moving the latch into and out of engagement with the blocking bar respectively locking and unlocking the gate, the pinion and the coupling member having a lost motion connection therebetween by which initial movement of the operating shaft, when the gate is to be opened, effects unlocking of the gate prior to movement of the rack by the pinion, with a subsequent movement of the shaft, when the gate is closed, reengaging the latch with the blocking bar to lock the gate in its closed position.

15. The apparatus of claim 14 wherein the pinion has a hollow pinion sleeve sized for the pinion to fit over the operating shaft, the pinion sleeve having opposed collar segments formed at one end thereof and extending longitudinally of the operating shaft.

16. The apparatus of claim 15 in which the pinion comprises a hollow pinion sleeve sized for the coupling member to be fitted onto the operating shaft, the coupling sleeve having opposed collar segments formed at one end and extending longitudinally of the operating shaft, the collar segments of the pinion interfitting with the collar segments of the coupling member.

17. The apparatus of claim 16 wherein the size of the respective collar segments on the pinion and coupling member is such that the coupling member rotates approximately 20°–35° prior to the collar segments thereof contact collar segments of the pinion, this movement of the coupling member lifting the latch out of engagement with the blocking bar away to unlock the gate for opening movement, and when the pinion moves the gate to its closed position, allowing the coupling member to continue to rotate to bring the latch back into engagement with blocking bar to lock the gate in its closed position.

18. The apparatus of claim 17 further including support means for supporting one end of the pinion sleeve, the assembly including first and second mating block sections having a central opening in which the one end of the pinion sleeve is received for supporting the pinion during its rotation by the coupling member.

19. In a gravity outlet for discharging grain from a railway car, the outlet including an outlet assembly attached to a discharge opening in the railcar and having an upper end attached to the discharge opening, and sidewalls and endwalls whose lower portion defines a discharge outlet through which the grain flows, by gravity, from the railcar, an outlet gate positioned beneath the outlet and movable relative thereto to open and close the outlet, a rack attached to the gate, a pinion engaged with the rack, an operating shaft extending transversely of the outlet, and a capstan attached to each end of the operating shaft for a yardman to effect opening of the gate from either side of the railcar, the improvement comprising:

latch means including a latch attached to the gate for latching the outlet gate in its closed position when the gate is closed to prevent inadvertent opening of the gate and spillage of lading;

a coupling member carried on the operating shaft and engaging the pinion; and, a blocking bar into and out of engagement with the latch is movable to lock and unlock the gate, the pinion and the coupling member having a lost motion connection therebetween by which initial movement of the coupling member, when the gate is to be opened, moves the latch out of engagement with the blocking bar to effect unlocking of the gate prior to movement of the rack by the pinion, and subsequent movement of the coupling member, when the gate is being closed, re-engaging the latch with the blocking bar to lock the gate closed, the operating shaft being generally circular in cross-section and having a first section over which the pinion is mounted, the pinion having a central opening therethrough sized for the pinion to fit over the operating shaft, the pinion including a pinion sleeve having an inner diameter greater than that of the operating shaft, opposed collar segments being formed at one end of the pinion sleeve and extending longitudinally of the operating shaft after installation of the pinion thereon, and a second section to which the capstan is connected and on which the coupling member is mounted, the coupling member comprising a hollow cylindrical coupling sleeve sized for the coupling member to be received on the operating shaft, with opposed collar segments being formed at one end of the coupling sleeve and extending longitudinally of the operating shaft after installation of the coupling member thereon, the collar segments of the pinion interfitting with the collar segments of the coupling member, the coupling member rotating approximately 20°–35° prior to the collar segments thereof contacting collar segments of the pinion for this initial movement of the coupling member to lift the gate latch out of engagement with the blocking bar to unlock the gate, the collar segments of the coupling member then interlocking with the collar segments of the pinion for continued movement of the capstan to effect rotation of the pinion to move the gate in its opening direction, the collar segments of the coupling member and pinion remaining interlocked when the capstan is turned in the opposite direction to close the gate, for the pinion to move the gate to its closed position, the coupling member continuing to be rotated after the gate is closed to bring latch back into engagement with the blocking bar to lock the gate in its closed position, the latch being pivotally attached to the gate and having an outer face engaging the blocking bar when the latch is brought into engagement therewith by rotation of the coupling member; and support means for supporting one end of the pinion sleeve, the support means comprising a pillow block assembly mounted on a support member for the outlet and having an opening therein through in which the one end of the pinion sleeve is received.

20. A gravity outlet for discharging lading from a railway car comprising:

an outlet assembly attached to a discharge opening in the railway car and including an upper end attached to the discharge opening and sidewalls and endwalls sloping downwardly and inwardly from the upper end with a bottom portion of the sidewalls and endwalls defining a discharge outlet through which the lading flows from the railway car;

an outlet gate positioned beneath the outlet assembly and movable relative to the discharge outlet between respective open and closed positions to open and close the outlet;

a latch attached to the gate for latching the gate in its closed position when the gate is closed to prevent opening of the gate and spillage of lading;

gate operating means including a rack attached to the gate and a pinion engaging the rack for moving the rack and the gate, an operating shaft including moving means at an end of the shaft by which a yardman can open and close the gate by turning the moving means in the appropriate direction, the pinion being coupled to the shaft for rotation in the appropriate direction to move the gate between its open and closed positions; and, blocking means engaging the latch to lock the gate in its closed position, the blocking means including a blocking bar engaging the latch with the latch being moved out of engagement with the blocking bar prior to the gate being opened by movement of the shaft in one direction to unlock the gate and the latch being moved into engagement with the blocking bar subsequent to the gate being closed by movement of the shaft in the opposite direction to lock the gate in its closed position, there being a lost motion connection between the operating shaft and the pinion by which an initial movement of the shaft effects unlocking of the gate prior to the gate being opened, and a movement of the shaft subsequent to the gate being closed effects locking of the gate.

* * * * *